US007468576B2

(12) United States Patent
Kasak et al.

(10) Patent No.: US 7,468,576 B2
(45) Date of Patent: Dec. 23, 2008

(54) MULTI-SEGMENT FILAMENT HIGH OUTPUT HALOGEN LAMP

(75) Inventors: Alexander N. Kasak, El Paso, TX (US); Victor Cordero Cabrales, Juarez (MX); Heinz W. Sell, Cushing, ME (US); Michael Achim Willacker, Germendorf (DE)

(73) Assignee: Osram Sylvania Inc., Danvers, MA (US)

( * ) Notice: Subject to any disclaimer, the term of this patent is extended or adjusted under 35 U.S.C. 154(b) by 526 days.

(21) Appl. No.: 11/065,218

(22) Filed: Feb. 24, 2005

(65) Prior Publication Data

US 2005/0156501 A1 Jul. 21, 2005

(51) Int. Cl.
*H01J 1/88* (2006.01)
*H01J 5/50* (2006.01)
*H01K 1/02* (2006.01)

(52) U.S. Cl. ..... 313/272; 313/333; 313/341

(58) Field of Classification Search ..... 313/271–274, 313/269, 277–279, 578–580, 220, 222, 631–632, 313/623, 333, 341–345
See application file for complete search history.

(56) References Cited

U.S. PATENT DOCUMENTS

| | | | | |
|---|---|---|---|---|
| 1,508,302 | A * | 9/1924 | Schnur | 313/276 |
| 2,605,440 | A | 7/1952 | Gero | 313/344 |
| 3,986,067 | A * | 10/1976 | De Fraeye | 313/273 |
| 4,367,428 | A * | 1/1983 | Notelteirs et al. | 313/578 |
| 4,766,339 | A | 8/1988 | Berry et al. | 313/276 |
| 5,268,613 | A | 12/1993 | Cunningham | 313/113 |
| 6,798,138 | B2 | 9/2004 | Gervelmeyer et al. | 313/110 |

* cited by examiner

*Primary Examiner*—Nimeshkumar D. Patel
*Assistant Examiner*—Anne M Hines
(74) *Attorney, Agent, or Firm*—Carlo S. Gessone

(57) ABSTRACT

A high output halogen lamp having five filament segments with four segments in a circular arrangement surrounding a fifth segment positioned directly in the center of the lamp axis which contributes to the high output and a more uniform light distribution.

12 Claims, 2 Drawing Sheets

MULTI-SEGMENT FILAMENT HIGH OUTPUT HALOGEN LAMP

BACKGROUND OF THE INVENTION

1. Field of the Invention

This invention relates generally to a high output halogen incandescent lamp and in particular to a multi-segment filament halogen lamp with four segments circling a fifth segment positioned in the center and located on the lamp axis.

2. Description of Related Art

In halogen lamps where multi-segment filaments are used, the filament segments are parallel to the lamp/fixture axis and symmetrically arranged in a circular pattern around the axis. Single linear arrangements of segments as well as staggered arrangements are often used.

The efficiency of a filament depends on its loading (lumens/watt), and the efficiency is affected by the degree of self-blocking of the radiated light within the filament because of its particular geometric arrangement. There are two conflicting forces at play. To best approximate the ideal light source (point source), a filament must be compact. To minimize the self-blocking effect, radiant elements must be spread out. An efficient, finite filament must consider and blend both effects. The filament geometry must mesh well with the fixture's reflector and other optical components in order to extend efficiency beyond the lamp to the lamp/fixture system, which places further restrictions on the filament structure design.

Prior art patents include U.S. Pat. No. 4,766,339 issued Aug. 23, 1988 to William L. Berry et al. and assigned to GTE Products Corp. which discloses an electric lamp including an envelope having a sealed end portion with a reinforced filament structure within the envelope having a plurality of several individual coated tungsten filaments connected in series, a first insulative bridge located within the envelope between the filament structure and the sealed end portion, first and second lead-in conductors coupled to the filament structure, first and second support wires extending within the envelope adjacent to the first and second conductors for supporting the filament structures, and reinforcement means in the form of a pair of platinum-clad molybdenum wire members being disposed at a location below the first insulative bridge and above the sealed end portion. The electric lamp preferably includes a halogen atmosphere within the envelope. However, although there are multi-segment filaments known as a C13 type filament, it does not relate filament geometry to fixture/reflector geometry.

U.S. Pat. No. 5,268,613 issued Dec. 7, 1993 to David W. Cunningham and assigned to Gregory Esakoff which discloses an incandescent illumination system for projecting a beam of light comprising a concave reflector and an incandescent lamp having a plurality of linear, helically-wound filaments arranged with their longitudinal axis substantially parallel with and spaced substantially around the longitudinal axis of the concave reflection. A substantial portion of the light emitted by the lamp impinges on, and is redirected by the reflector to project a beam of light substantially parallel with the longitudinal axis of the reflector. However, invention is based on coupling filament geometry to that of the fixture, and its four segments tend to have a four-lobed beam. The central segment of the present invention fills-in such lobed beams.

U.S. Pat. No. 6,798,138 issued Sep. 28, 2004 to Rolf Gervelmeyer et al. and assigned to Koninklijke Philips Electronics, N.V., discloses a halogen incandescent lamp for motor vehicles with an elongated bulb which is closed at one end and has a vacuum-tight pinch seal at the other end with a lamp cap connected to the pinch seal and with current supply leaders which are passed through the pinch seal to the incandescent element, and an annular optical absorption filter is provided at the closed end of the bulb with a coating of at least one layer of cobalt aluminate. Although illumination properties are improved, it does not provide a high output. The coating on the bulb filters out higher wavelengths resulting in a lamp output that is more blue/white in an attempt to mimic the spectrum of the new discharge headlights.

SUMMARY OF THE INVENTION

Accordingly, it is therefore an object of this invention to provide a high output halogen lamp having a more uniform light distribution.

It is another object of this invention to provide a halogen lamp comprising a circular arrangement of four filament segments surrounding a fifth filament segment positioned directly in the center of the lamp axis.

These and other objects are further accomplished by a halogen lamp comprising an envelope having a bulbous portion at a first end and an opened second end for attaching to a base, a pair of spaced-apart insulating bridges disposed within the envelope, a multi-segment filament structure positioned between the pair of insulating bridges, the filament structure comprises a series of filament segments arranged in a circular pattern with another filament segment positioned in the center of the circular pattern and the lamp, and at least two-support leads attached to the spaced-apart insulating bridges and extending through support segments attached to ends of the series of filament segments. The base comprises metal contact pins extending below the base for providing power to the multi-segment filament structure. At least two support leads attach to sealing foils extending from the base within the envelope. The envelope comprises a quartz elongated bulb. The pair of spaced-apart insulating bridges comprises quartz material. The series of filament segments comprises five active filament segments. The series of filament segments arranged in a circular pattern comprises polar symmetry in the shape of a square.

The objects are further accomplished by a method of providing a halogen lamp comprising the steps of providing an envelope having a bulbous portion at a first end and an opened second end for attaching to a base, disposing a pair of spaced-apart insulating bridges within the envelope, positioning a multi-segment filament structure between the pair of insulating bridges, the filament structure comprises a series of filament segments arranged in a circular pattern with another filament segment positioned in the center of the circular pattern and the lamp, and attaching at least two support leads to the spaced apart insulating bridges and extending through support segments attached to ends of the series of filament segments. The step of providing an envelope having a bulbous portion at a first end and an opened second end for attaching to a base comprises the step of providing metal contact pins extending below the base for providing power to the multi-segment filament structure. The method comprises the step of attaching sealing foils extending from the base within the envelope to the at least two support leads. The step of providing an envelope comprises the step of providing a quartz elongated bulb envelope. The step of disposing the pair of spaced-apart insulating bridges within the envelope comprises the step of providing quartz insulating bridges. The step of positioning the multi-segment filament structure between the pairs of insulating bridges comprises the step of providing five active filament segments in the series of filament segments. The method comprises the step of arranging the series of filament segments in a circular pattern having polar symmetry in the shape of a square.

Additional objects, features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENT

Figure 1:
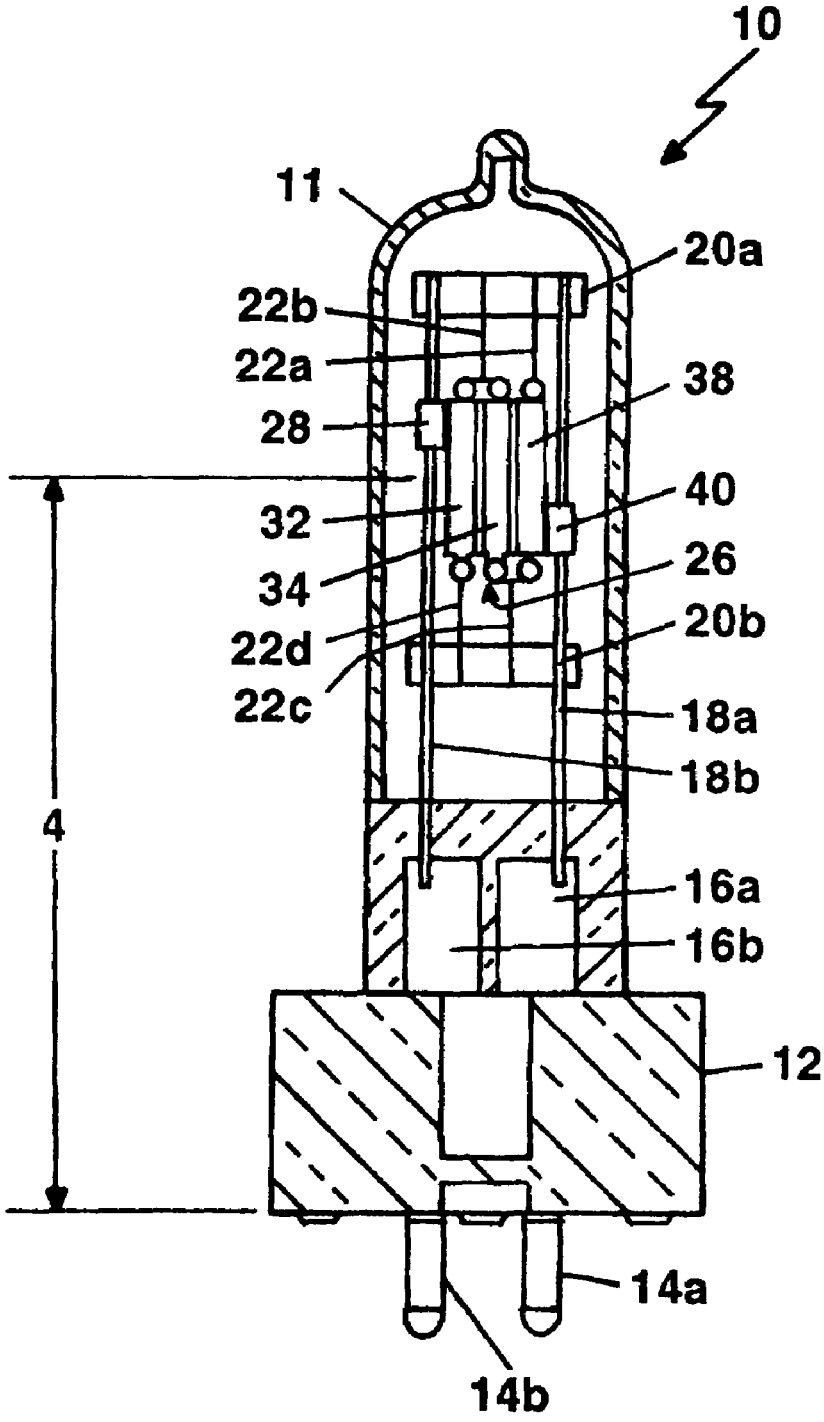
FIG. 1 is a front elevational view in section of a high output halogen lamp in accordance with a preferred embodiment of the invention.

Referring to FIG. 1, a front elevational view in section of a high output halogen lamp 10 is shown according to the present invention. The halogen lamp 10 comprises a quartz bulb 11 having a bulbous portion at one end and a second end that fits into a ceramic base 12 having two metal contact pins 14*a*, 14*b* extending from the bottom of the base 12. Two molybdenum sealing foils 16*a*, 16*b* extend above the ceramic base 12, and an end of each of two filament support leads 18*a*, 18*b* attaches to one of the sealing foils 16*a*, 16*b* respectively. A multi-segment filament structure 26 is positioned between two quartz support, insulating bridges 20*a*, 20*b*.

Still referring to FIG. 1, the multi-segment filament structure 26 comprises filament segments 30-38 and two support segments 28, 40. Four of the filament segments 30, 32, 36, 38 are in a symmetrical circular arrangement (a square) with the fifth segment 34 at the center, which is also the lamp axis.

One of the filament support leads 18*a* extends through support segment 40 of the filament segment structure 26, and the other filament support lead 18*b* extends through support segment 28. Filament support hooks 22*a*, 22*b*, 22*c* and 22*d* are provided from the insulating bridges 20*a*, 20*b* to the top and bottom ends of the individual filament segments 30-38. The high output halogen lamp operates at 1200 watts/80 volts, and higher wattage and voltage embodiments may be constructed using a similar circular multi-segment filament structure having a center segment.

Figure 2:
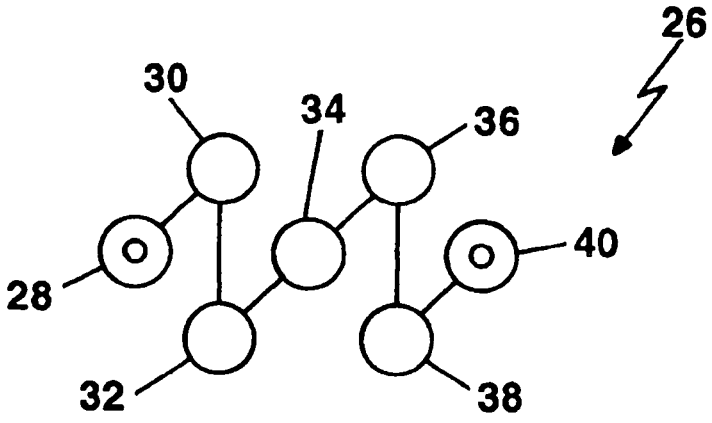
FIG. 2 illustrates a top view of a multi-segment filament structure of the preferred embodiment of FIG. 1.

Referring to FIG. 2, a top view of the multi-segment filament structure 26 is illustrated showing the fifth filament segment 34 in the center of the surrounding filament segments 30, 32, 36, 38 which actually form a square.

Figure 3:
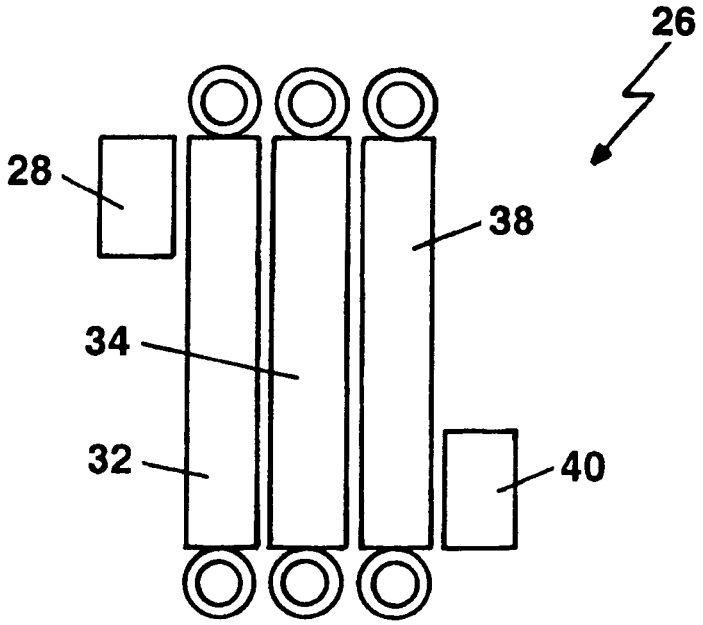
FIG. 3 is a front view of the multi-segment filament structure of FIG. 2.

Referring to FIG. 3, a front view of the multi-segment filament structure 26 is illustrated showing the active filament segments 32, 34 and 38 and the non-active support segments 28 and 40 which are much shorter in height and receive the filament support leads 18*a*, 18*b* when assembled in the lamp 10. The active filament segments 30-38 are the same height in the lamp 10.

The multi-segment filament structure 26 is constructed as a single coil wound on a mandrel with spaces to separate one filament segment from another. For a five active segment filament structure 26 as shown in FIG. 2, seven segments 30-38 are actually wound, whereby the two other segments 28 and 40 are not active filaments, but instead used only to support the complete multi-segment filament structure 26. The single coil is then folded with the multi-segment filaments 30-38 positioned approximately in their relative final positions.

Tungsten tooling is used to accurately position each segment in the lamp 10, and then the multi-segment filament 26 is fired at high temperature in either vacuum or reducing atmosphere to re-crystallize the tungsten atoms and purify the material.

Two tungsten support leads 18*a*, 18*b* are used to hold the multi-segment filament structure 26 within the lamp 10 and to act as power leads to the filament structure 26. The tungsten support leads 18*a*, 18*b* are electrically separated by the fused quartz bridges 20*a*, 20*b*, and the bridges 20*a*, 20*b* may be fused directly to the support leads 18*a*, 18*b* or made with small coils to slip over the support leads 18*a*, 18*b* and provide a means of filament tensioning. The ends of support leads 18*a*, 18*b* are welded to the molybdenum foils 16*a*, 16*b*. The quartz bulb 11 is pressed around the molybdenum foils 16*a*, 16*b*, effectively sealing the feedthrough assembly in the ceramic base 12.

Power is applied to heat the multi-segment filament structure 26 in a reducing atmosphere to purify the filament and other internal components. The bulb 11 is then exhausted as a conventional halogen lamp, filled with inert gas/hydrogen bromide mixture, and exhaust tub sealed. The last steps include fusing, attaching the base 12 to the capsule (bulb 11 and components enclosed therein) including electrical connections from capsule to external terminals or pins at a correct filament light center or light center length (LCL). The light center length (LCL) 4 is the distance from a reference point on the base to the center of the filament along lamp axis. This requirement ensures that the optical center of the light source (filament) ends up in the optically correct location in regard to the application (i.e. at focal point of a reflector).

Actual dimensions and spacing of components within the halogen lamp 10 are determined by such factors as filament diameter and length, optical considerations, filament wattages and voltage, and potential for arcing and bulb size. For example, for the 1200 Watt/80 Volt lamp embodiment the specifications are as follows:

Segment OD=0.089";

Radius (center of filament to center of segments around center)=0.149";

Segment length (active)=0.512"; and

Outer segment arrangement is equidistant or equiangular (i.e. three outer segments at 120 degrees, four at 90 degrees, five at 72 degrees, etc.), in other words, polar symmetry.

To reap the benefits of compactness, this embodiment places one or more filament segments on or close to the lamp axis, and in most such cases, the lamp axis is located on the fixture (optical) axis. This location provides the highest attainable (by reflectors in fixture) efficiency. The open arrangement of the filament segments in the outer position provides a large, unblocked radiating area from each segment in the outer layer and minimizes blocking of light from segments in the core. The preferred embodiment offers the following benefits:

1. High fixture efficiency defined as:

$$\frac{\text{Useable or fixture output}}{\text{Total (integrated) lamp output}}$$

2. Improved polar uniformity of light output from the lamp which translates to improved uniformity from a fixture.

This invention has been disclosed in terms of a certain embodiment. It will be apparent that many modifications can be made to the disclosed apparatus without departing from the invention. For example, the multi-segment filament structure is not limited to five active segments, but there may be any number of segment filaments in a circular arrangement around a segment filament in the center. Therefore, it is the intent of the appended claims to cover all such variations and modifications as come within the true spirit and scope of this invention.

What is claimed is:

1. A halogen lamp comprising:

an envelope arrayed about a longitudinal axis and having a bulbous portion at a first end and an opened second end for attaching to a base;

a pair of spaced-apart insulating bridges disposed within said envelope;

a multi-segment filament structure positioned between said pair of insulating bridges, said filament structure comprising a series of filament segments arranged in a circular pattern with another filament segment positioned in the center of said circular pattern and coaxially aligned with said longitudinal axis; and at least two support leads attached to said spaced apart insulating bridges and extending through support segments attached to ends of said series of filament segments.

2. The halogen lamp as recited in claim 1 wherein said base comprises metal contact pins extending below said base for providing power to said multi-segment filament structure.

3. The halogen lamp as recited in claim 1 wherein said at least two support leads attach to sealing foils extending from said base within said envelope.

4. The halogen lamp as recited in claim 1 wherein said envelope comprises a quartz elongated bulb.

5. The halogen lamp as recited in claim 1 wherein said pair of spaced-apart insulating bridges comprises quartz material.

6. The halogen lamp as recited in claim 1 wherein said series of filament segments comprises five active filament segments.

7. A method of providing a halogen lamp comprising the steps of:

providing an envelope arrayed about a longitudinal axis and having a bulbous portion at a first end and an opened second end for attaching to a base;

disposing a pair of spaced-apart insulating bridges within said envelope;

positioning a multi-segment filament structure between said pair of insulating bridges, said filament structure comprising a series of filament segments arranged in a circular pattern with another filament segment positioned in the center of said circular pattern and coaxially aligned with said longitudinal axis; and attaching at least two support leads to said spaced apart insulating bridges and extending through support segments attached to ends of said series of filament segments.

8. The method as recited in claim 7 wherein said step of providing an envelope having a bulbous portion at a first end and an opened second end for attaching to a base comprises the step of providing metal contact pins extending below said base for providing power to said multi-segment filament structure.

9. The method as recited in claim 7 wherein said method comprises the step of attaching sealing foils extending from said base within said envelope to said at least two support leads.

10. The method as recited in claim 7 wherein said step of providing an envelope comprises the step of providing a quartz elongated bulb envelope.

11. The method as recited in claim 7 wherein said step of disposing said pair of spaced-apart insulating bridges within said envelope comprises the step of providing quartz insulating bridges.

12. The method as recited in claim 7 wherein said step of positioning said multi-segment filament structure between said pairs of insulating bridges comprises the step of providing five active filament segments in said series of filament segments.

* * * * *